US006491362B1

(12) United States Patent
Jeanmaire

(10) Patent No.: US 6,491,362 B1
(45) **Date of Patent: *Dec. 10, 2002**

(54) CONTINUOUS INK JET PRINTING APPARATUS WITH IMPROVED DROP PLACEMENT

(75) Inventor: David L. Jeanmaire, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 36 days.

This patent is subject to a terminal disclaimer.

(21) Appl. No.: 09/910,405

(22) Filed: Jul. 20, 2001

(51) Int. Cl.[7] ..... B41J 2/205
(52) U.S. Cl. ..... 347/15; 347/74; 347/75
(58) Field of Search ..... 347/15, 43, 73, 347/82, 74, 77, 90, 75

(56) References Cited

U.S. PATENT DOCUMENTS

| | | | | |
|---|---|---|---|---|
| 1,941,001 | A | 12/1933 | Hansell | 178/96 |
| 3,373,437 | A | 3/1968 | Sweet et al. | 347/74 |
| 3,416,153 | A | 12/1968 | Hertz et al. | 347/73 |
| 3,709,432 | A | 1/1973 | Robertson | 239/4 |
| 3,878,519 | A | 4/1975 | Eaton | 347/75 |
| 4,190,844 | A | 2/1980 | Taylor | 347/82 |
| 4,346,387 | A | 8/1982 | Hertz | 347/75 |
| 4,638,382 | A | 1/1987 | Drake et al. | 360/68 |
| 4,914,522 | A | 4/1990 | Duffield et al. | 358/296 |
| 5,224,843 | A | 7/1993 | vanLintel | 417/413.2 |
| 6,079,821 | A | 6/2000 | Chwalek et al. | 347/82 |

*Primary Examiner*—Lamson Nguyen
(74) *Attorney, Agent, or Firm*—Milton S. Sales

(57) ABSTRACT

An apparatus for printing an image is provided. In this apparatus, each nozzle is operable to selectively create a stream of ink droplets having a plurality of volumes. The apparatus also includes a droplet deflector having a gas source. The gas source is positioned at an angle with respect to the stream of ink droplets and is operable to interact with the stream of ink droplets thereby separating ink droplets into printing and non-printing paths. Additionally, the apparatus includes a means for improving drop placement on the receiver media. This allows for multiple printing drops per image pixel without loss of image sharpness.

10 Claims, 6 Drawing Sheets

CONTINUOUS INK JET PRINTING APPARATUS WITH IMPROVED DROP PLACEMENT

CROSS REFERENCE TO RELATED APPLICATIONS

Reference is made to commonly assigned, co-pending U.S. patent applications Ser. No. 09/750,946, filed in the names of David L. Jeanmaire et al. on Dec. 28, 2000; Ser. No. 09/861,692 filed in the name of David L. Jeanmaire on May 21, 2001; and Ser. No. 09/892,831 filed in the name of David L. Jeanmaire on Jun. 27, 2001.

FIELD OF THE INVENTION

This invention relates generally to the field of digitally controlled printing devices, and in particular to continuous ink jet printers in which a liquid ink stream breaks into droplets, some of which are selectively deflected.

BACKGROUND OF THE INVENTION

Traditionally, digitally controlled color ink jet printing capability is accomplished by one of two technologies. Both require independent ink supplies for each of the colors of ink provided. Ink is fed through channels formed in the print head. Each channel includes a nozzle from which droplets of ink are selectively extruded and deposited upon a receiving medium. Typically, each technology requires separate ink delivery systems for each ink color used in printing. Ordinarily, the three primary subtractive colors, i.e. cyan, yellow and magenta, are used because these colors can produce, in general, up to several million perceived color combinations.

The first technology, commonly referred to as "drop-on-demand" ink jet printing, typically provides ink droplets for impact upon a recording surface using a pressurization actuator (thermal, piezoelectric, etc.). Selective activation of the actuator causes the formation and ejection of a flying ink droplet that crosses the space between the print head and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

With thermal actuators, a heater, located at a convenient location, heats the ink causing a quantity of ink to phase change into a gaseous steam bubble. This increases the internal ink pressure sufficiently for an ink droplet to be expelled. The bubble then collapses as the heating element cools, and the resulting vacuum draws fluid from a reservoir to replace ink that was ejected from the nozzle.

Piezoelectric actuators, such as that disclosed in U.S. Pat. No. 5,224,843, issued to vanLintel, on Jul. 6, 1993, have a piezoelectric crystal in an ink fluid channel that flexes when an electric current flows through it forcing an ink droplet out of a nozzle. The most commonly produced piezoelectric materials are ceramics, such as lead zirconate titanate, barium titanate, lead titanate, and lead metaniobate.

In U.S. Pat. No. 4,914,522, which issued to Duffield et al. on Apr. 3, 1990, a drop-on-demand ink jet printer utilizes air pressure to produce a desired color density in a printed image. Ink in a reservoir travels through a conduit and forms a meniscus at an end of an ink nozzle. An air nozzle, positioned so that a stream of air flows across the meniscus at the end of the nozzle, causes the ink to be extracted from the nozzle and atomized into a fine spray. The stream of air is applied for controllable time periods at a constant pressure through a conduit to a control valve. The ink dot size on the image remains constant while the desired color density of the ink dot is varied depending on the pulse width of the air stream.

The second technology, commonly referred to as "continuous stream" or "continuous" ink jet printing, uses a pressurized ink source that produces a continuous stream of ink droplets. Conventional continuous ink jet printers utilize electrostatic charging devices that are placed close to the point where a filament of ink breaks into individual ink droplets. The ink droplets are electrically charged and then directed to an appropriate location by deflection electrodes. When no print is desired, the ink droplets are directed into an ink-capturing mechanism (often referred to as catcher, interceptor, or gutter). When print is desired, the ink droplets are directed to strike a print media.

Typically, continuous ink jet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an array of continuous ink jet nozzles wherein ink droplets to be printed are selectively charged and deflected towards the recording medium. This technique is known as binary deflection continuous ink jet.

U.S. Pat. No. 3,416,153, issued to Hertz et al. on Oct. 6, 1963, discloses a method of achieving variable optical density of printed spots in continuous ink jet printing using the electrostatic dispersion of a charged droplet stream to modulate the number of droplets which pass through a small aperture.

U.S. Pat. No. 3,878,519, issued to Eaton on Apr. 15, 1975, discloses a method and apparatus for synchronizing droplet formation in a liquid stream using electrostatic deflection by a charging tunnel and deflection plates.

U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,382, issued to Drake et al. on Jan. 20, 1987, discloses a continuous ink jet print head that utilizes constant thermal pulses to agitate ink streams admitted through a plurality of nozzles in order to break up the ink streams into droplets at a fixed distance from the nozzles. At this point, the droplets are individually charged by a charging electrode and then deflected using deflection plates positioned the droplet path.

As conventional continuous ink jet printers utilize electrostatic charging devices and deflector plates, they require many components and large spatial volumes in which to operate. This results in continuous ink jet print heads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniformly spaced ink droplets through the use of transducers. The lengths of the filaments before they break up into ink droplets are regulated by controlling the stimulation energy supplied to the transducers, with high amplitude stimulation resulting in short filaments and low amplitude stimulations resulting in longer filaments. A flow of air is generated across the paths of the fluid at a point intermediate to the ends of the long and short filaments. The air flow affects the trajectories of the filaments before they break up into droplets more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous ink jet printer having a first pneumatic deflector for deflecting non-printed ink droplets to a catcher and a second pneumatic deflector for oscillating printed ink droplets. A print head supplies a filament of working fluid that breaks into individual ink droplets. The ink droplets are then selectively deflected by a fist pneumatic deflector, a second pneumatic deflector, or both. The first pneumatic deflector is an "on/off" type having a diaphragm that either opens or closes a nozzle depending on one of two distinct electrical signals received from a central control unit. This determines whether the ink droplet is to be printed or non-printed. The second pneumatic deflector is a continuous type having a diaphragm that varies the amount that a nozzle is open, depending on a varying electrical signal received the central control unit. This oscillates printed ink droplets so that characters may be printed one character at a time. If only the first pneumatic deflector is used, characters are created one line at a time, being built up by repeated traverses of the print head.

While this method does not rely on electrostatic means to affect the trajectory of droplets, it does rely on the precise control and timing of the first ("ON/OFF") pneumatic deflector to create printed and non-printed ink droplets. Such a system is difficult to manufacture and accurately control, resulting in at least the ink droplet build up discussed above. Furthermore, the physical separation or amount of discrimination between the two droplet paths is erratic due to the precise timing requirements, increasing the difficulty of controlling printed and non-printed ink droplets and resulting in poor ink droplet trajectory control.

Additionally, using two pneumatic deflectors complicates construction of the print head and requires more components. The additional components and complicated structure require large spatial volumes between the print head and the media, increasing the ink droplet trajectory distance. Increasing the distance of the droplet trajectory decreases droplet placement accuracy and affects the print image quality. Again, there is a need to minimize the distance that the droplet must travel before striking the print media in order to insure high quality images.

U.S. Pat. No. 6,079,821, issued to Chwalek et al. on Jun. 27, 2000, discloses a continuous ink jet printer that uses actuation of asymmetric heaters to create individual ink droplets from a filament of working fluid and to deflect those ink droplets. A print head includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher. While the ink jet printer disclosed in Chwalek et al. works extremely well for its intended purpose, it is best adapted for use with inks that have a large viscosity change with temperature.

Each of the above-described ink jet printing systems has advantages and disadvantages. However, print heads which are low-power and low-voltage in operation will be advantaged in the marketplace, especially in page-width arrays. U.S. patent application Ser. No. 09/750,946, filed in the names of David L. Jeanmaire et al. on Dec. 28, 2000, discloses continuous-jet printing wherein nozzle heaters are selectively actuated at a plurality of frequencies to create the stream of ink droplets having the plurality of volumes. A gas stream provides a force separating droplets into printing and non-printing paths according to drop volume. While this process consumes little power, and is suitable for printing with a wide range of inks, the apparatus, when used in a printing mode which delivers multiple ink droplets per image pixel, can have a difficulty with registration of the ink droplets on the print media Often it is desirable to print with multiple drops per pixel to achieve multi-level printing, allowing higher print quality at the same resolution. Since the droplets are issued from the print head sequentially in time, some motion of the image receiver will occur between the time of arrival of the first droplet within a pixel, and the last droplet. Consequently, the droplets will not be registered to the same location on the receiver and a loss of image sharpness will occur, which is particularly evident in the printing of text. Therefore, it can be seen that there is an opportunity to provide an improvement to continuous ink jet printers. The features of low-power and low-voltage print head operation are desirable to retain, while providing for multi-level printing, without the concomitant loss of image sharpness.

SUMMARY OF THE INVENTION

An object of the present invention is to provide for improved droplet placement in multi-level printing in printers with print heads in which heat pulses are used to break up fluid into drops having a plurality of volumes, and which use a gas flow to separate the drops along printing and non-printing paths. This improved registration of printed droplets improves the quality of the image on the receiver media.

According to a feature of the present invention, a print head includes one or more nozzles from which a stream ink droplets are emitted. A mechanism for independently adjusting the volume of the droplets has a first state wherein the volumes of the droplets are within a first range of volumes, the first state being further defined by a substantially monotonically increasing or decreasing series of drop volumes within a grouping of two or more droplets. The mechanism has a second state wherein the volumes of the droplets are within a second range of volumes, wherein the second range of volumes being larger than the first range of volumes.

According to another feature of the present invention, printing apparatus includes a print head as described in the preceding paragraph, as well as having a droplet deflector adapted to produce a force on the emitted droplets. The force is applied to the droplets at an angle with respect to the stream of ink droplets to cause droplets having the first range of volumes to move along a first set of paths, and droplets having the second range of volumes to move along a second set of paths distinct from the first set of paths.

According to still another feature of the present invention, printing apparatus as described in the preceding paragraph further includes an ink catcher positioned to allow drops moving along the first set of paths to move unobstructed past the catcher, while intercepting drops moving along the second set of paths.

BRIEF DESCRIPTION OF THE DRAWINGS

Other features and advantages of the present invention will become apparent from the following description of the preferred embodiments of the invention and the accompanying drawings, wherein.

DETAILED DESCRIPTION OF THE INVENTION

Figure 1:
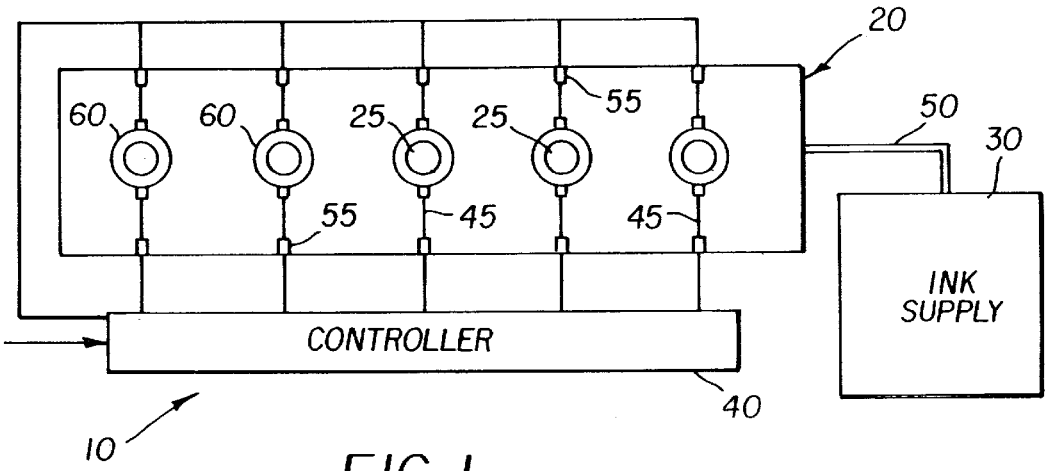
FIG. 1 is a schematic plan view of a print head made in accordance with a preferred embodiment of the present invention.

The present description will be directed in particular to elements forming part of, or cooperating more directly with, apparatus in accordance with the present invention. It is to be understood that elements not specifically shown or described may take various forms well known to those skilled in the art.

With reference to FIG. 1 through FIG. 7, like reference numerals designate like components throughout all of the figures.

FIG. 1 shows an ink droplet forming mechanism 10 of a preferred embodiment of the present invention, including a print head 20, at least one ink supply 30, and a controller 40. Although ink droplet forming mechanism 10 is illustrated schematically and not to scale for the sake of clarity, one of ordinary skill in the art will be able to readily determine the specific size and interconnections of the elements of a practical apparatus according to a specific desired application.

In a preferred embodiment of the present invention, print head 20 is formed from a semiconductor material, such as for example silicon, using known semiconductor fabrication techniques (CMOS circuit fabrication techniques, micro-electro mechanical structure (MEMS) fabrication techniques, etc.). However, print head 20 may be formed from any materials using any fabrication techniques conventionally known in the art.

As illustrated in FIG. 1, a row of nozzles is formed on print head 20. Nozzles 25 are in fluid communication with ink supply 30 through ink passage 50, also formed in print head 20. Single color printing, such as so-called black and white, may be accomplished using a single ink supply 30 and a single set of nozzles 25. In order to provide color printing using two or more ink colors, print head 20 may incorporate additional ink supplies in the manner of supply 30 and corresponding sets of nozzles 25.

A set of heaters 60 is at least partially formed or positioned on print head 20 around corresponding nozzles 25. Although heaters 60 may be disposed radially away from the edge of corresponding nozzles 25, they are preferably disposed close to corresponding nozzles 25 in a concentric manner. In a preferred embodiment, heaters 60 are formed in a substantially circular or ring shape. However, heaters 60 may be formed in a partial ring, square, etc. Heaters 60 in a preferred embodiment consist principally of an electric resistive heating element electrically connected to electrical contact pads 55 via conductors 45.

Conductors 45 and electrical contact pads 55 may be at least partially formed or positioned on print head 20 to provide an electrical connection between controller 40 and heaters 60. Alternatively, the electrical connection between controller 40 and heaters 60 may be accomplished in any well-known manner. Controller 40 is typically a logic controller, programmable microprocessor, etc. operable to control many components (heaters 60, ink droplet forming mechanism 10, etc.) in a desired manner.

Figure 2:
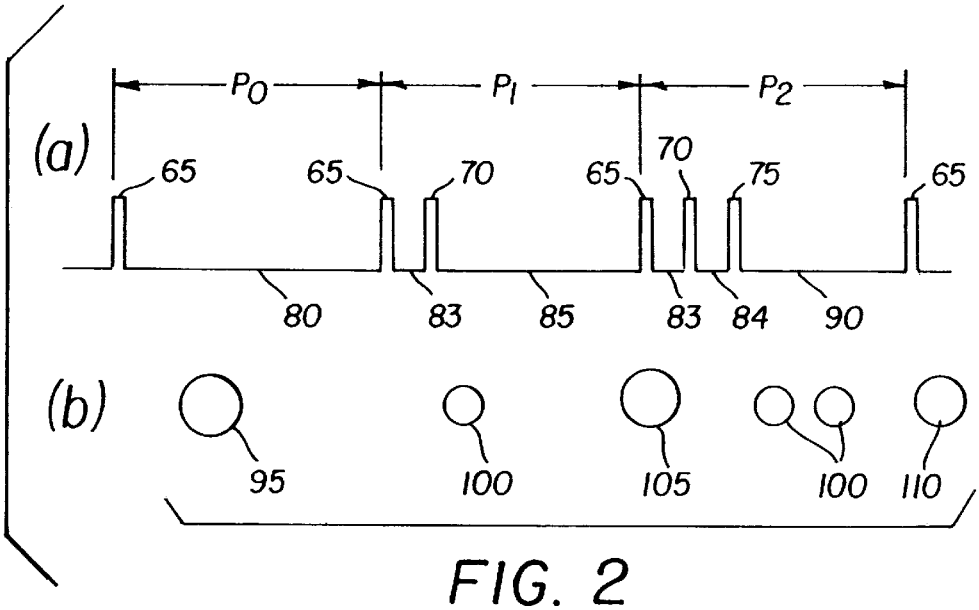
FIG. 2 is a diagram illustrating a frequency control of a heater as described in the prior art.

FIG. 2 is a schematic example of the electrical activation waveform provided by controller 40 to heaters 60 as described in the prior art. In general, rapid pulsing of heaters 60 forms small ink droplets, while slower pulsing creates larger drops. In the first example presented here, small ink droplets are to be used for marking the image receiver, while larger, non-printing droplets are captured for ink recycling.

In this example, multiple drops per nozzle per image pixel are created. Periods $P_0$, $P_1$, $P_2$, etc. are the times associated with the printing of associated image pixels, the subscripts indicating the number of printing drops to be created during the pixel time. The schematic illustration shows the drops that are created as a result of the application of the various waveforms. A maximum of two small printing drops is shown for simplicity of illustration, however, the concept can be readily extended to permit a greater maximum count of printing drops.

In the drop formation for each image pixel, a non-printing large drop 95, 105, or 110 is always created, in addition to a selectable number of small, printing drops. The waveform of activation of heater 60 for every image pixel begins with electrical pulse time 65. The further (optional) activation of heater 60, after delay time 83, with an electrical pulse 70 is conducted in accordance with image data wherein at least one printing drop 100 is required as shown for interval $P_1$. For cases where the image data requires that still another printing drop be created as in interval $P_2$, heater 60 is again activated after delay 83, with a pulse 75. Heater activation electrical pulse times 65, 70, and 75 are substantially similar, as are all delay times 83. Delay times 80, 85, and 90 are the remaining times after pulsing is over in a pixel time interval P and the start of the next image pixel. All small, printing drops 100 are the same volume. However, the volume of the larger, non-printing drops 95, 105 and 110, varies depending on the number of small drops 100 created in the pixel time interval P; as the creation of small drops takes mass away from the large drop during the pixel time interval P. The delay time 90 is preferably chosen to be significantly larger than the delay time 83, so that the volume ratio of large non-printing-drops 110 to small printing-drops 100 is a factor of about 4 or greater.

Figure 3:
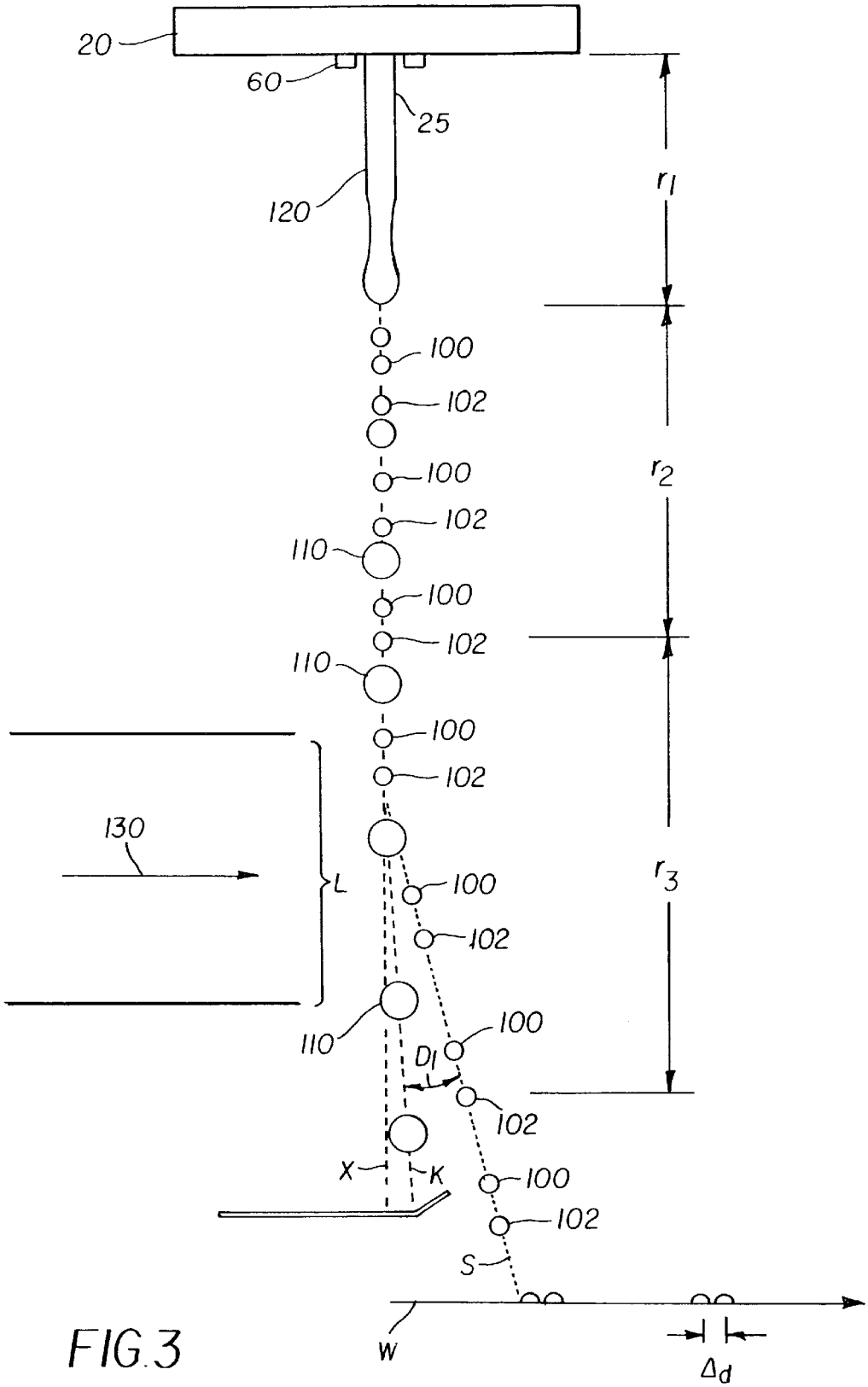
FIG. 3 is a cross-sectional view of an ink jet print head made in accordance with the prior art.

Referring to FIG. 3 as an example of the prior art, the operation of print head 20 in a manner such as to provide two printing drops per pixel, as described above, is coupled with a gas-flow discrimination means which separates droplets into printing or non-printing paths according to drop volume. Ink is ejected through nozzles 25 in print head 20, creating a filament of working fluid 120 moving substantially perpendicular to print head 20 along axis X. The physical region over which the filament of working fluid is intact is designated as $r_1$. Heaters 60 are selectively activated at various frequencies according to image data, causing filaments of working fluid 120 to break up into streams of individual ink droplets. Coalescence of drops often occurs in forming non-printing drops 110. This region of jet break-up and drop coalescence is designated as $r_2$.

Following region $r_2$, drop formation is complete in a region $r_3$, and small printing drops and large non-printing drops are spatially separated. A discrimination force 130 is provided by a gas flow at a non-zero angle with respect to axis X. For example, the gas flow may be perpendicular to axis X. Discrimination force 130 acts over distance L, which is less than or equal to distance $r_3$. Large, non-printing drops 110 have greater masses and more momentum than small volume drops 100. As gas force 130 interacts with the stream of ink droplets, the individual ink droplets separate, depending on individual volume and mass. The gas flow rate can be adjusted to provide sufficient deviation angle D between the small droplet path S and the large droplet paths K, thereby permitting small drops 100 to strike print media W while large, non-printing drops 110 are captured by a ink guttering structure described below.

Due to the motion of the print media W, during the total time interval for small droplet formation, time interval 83+time interval 70, the two printing drops for a pixel are separated by distance Δd on print media W. By means of example, if the time for small droplet formation is 5 microseconds and the velocity of the print media W is 4 m/s, then the relative placement error, Δd, is 20 microns. This size error is sufficient to cause a perceived decrease in image sharpness.

Figure 4:
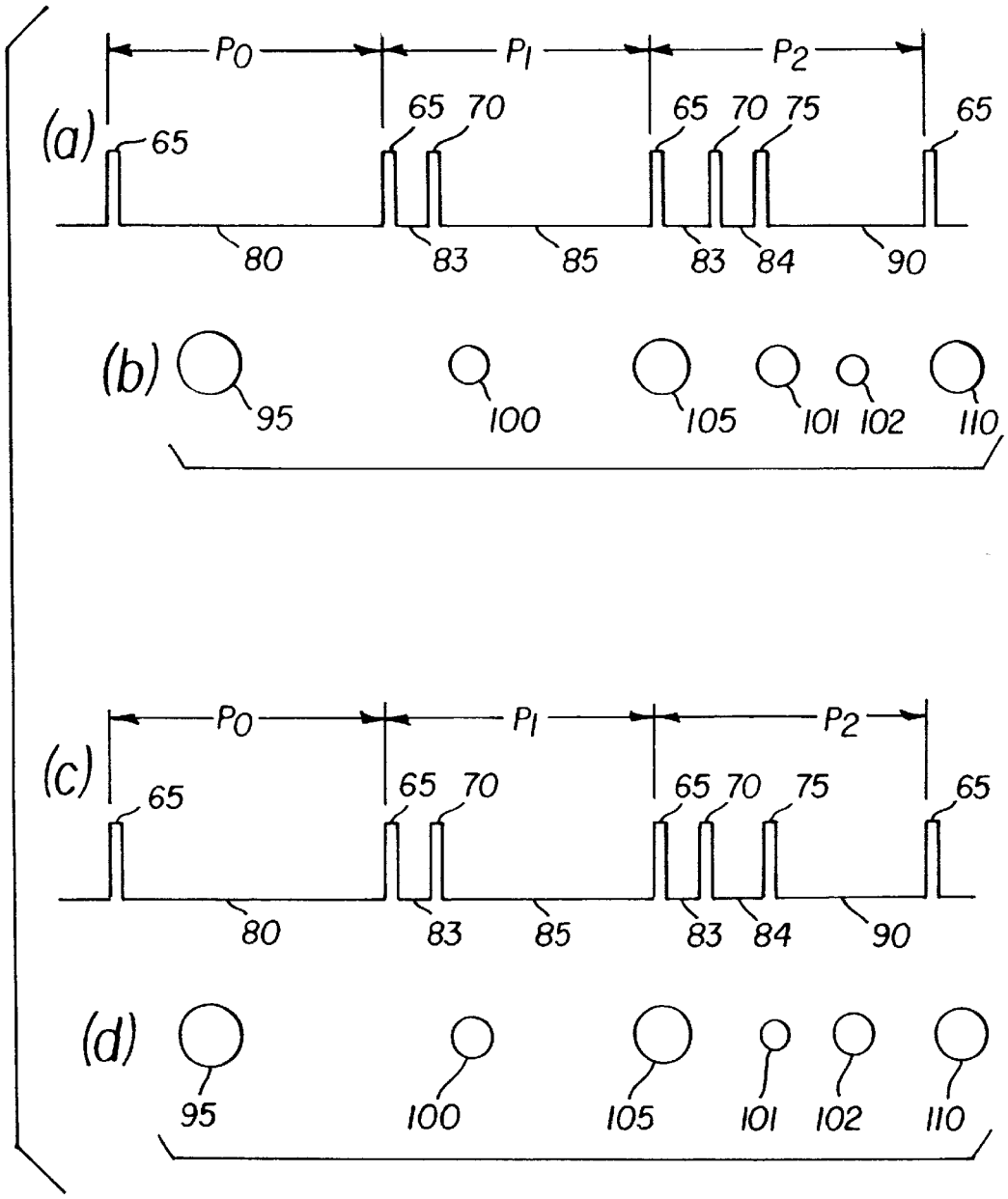
FIG. 4 is diagrams illustrating a frequency control of a heater as used in two embodiments of the present invention.

A first embodiment of the current invention is now described in part by FIG. 4, through diagrams (a) and (b). Diagram (a) represents the frequency of activation of heater 60, and is distinguished from the process of FIG. 2 (a) in that time interval 83 and time interval 84 are no longer equal, with time interval 83 greater than time interval 84. Consequently, for the printing level of two drops per pixel, represented by time $P_2$, a first printing small droplet 101 is formed with a larger volume relative to a second small droplet 102 as shown schematically in (b).

This concept is extended to printing levels in which more than two drops per pixel are created, the frequency of activation of heater 60 is increased, such that within a pixel, each successive printing drop is smaller than the preceding one. Electrical pulse time 65 is typically from about 0.1 microsecond to about 10 microseconds in duration, and is more preferentially about 0.5 microsecond to about 1.5 microseconds. Delay time 83 is typically about 1 to about 100 microseconds, and more preferentially, from about 3 microseconds to about 6 microseconds, while delay time 84 is from 1% to 50% shorter than delay time 83, and more preferentially, 10% to 20% shorter than delay time 84. More generally, we can defined a general relationship for multiple drops per pixel can be defined such that the constant value R is the $\log_{10}$ of the ratio of the delay time associated with drop n+1 to the delay time associated with drop n.

Figure 5:
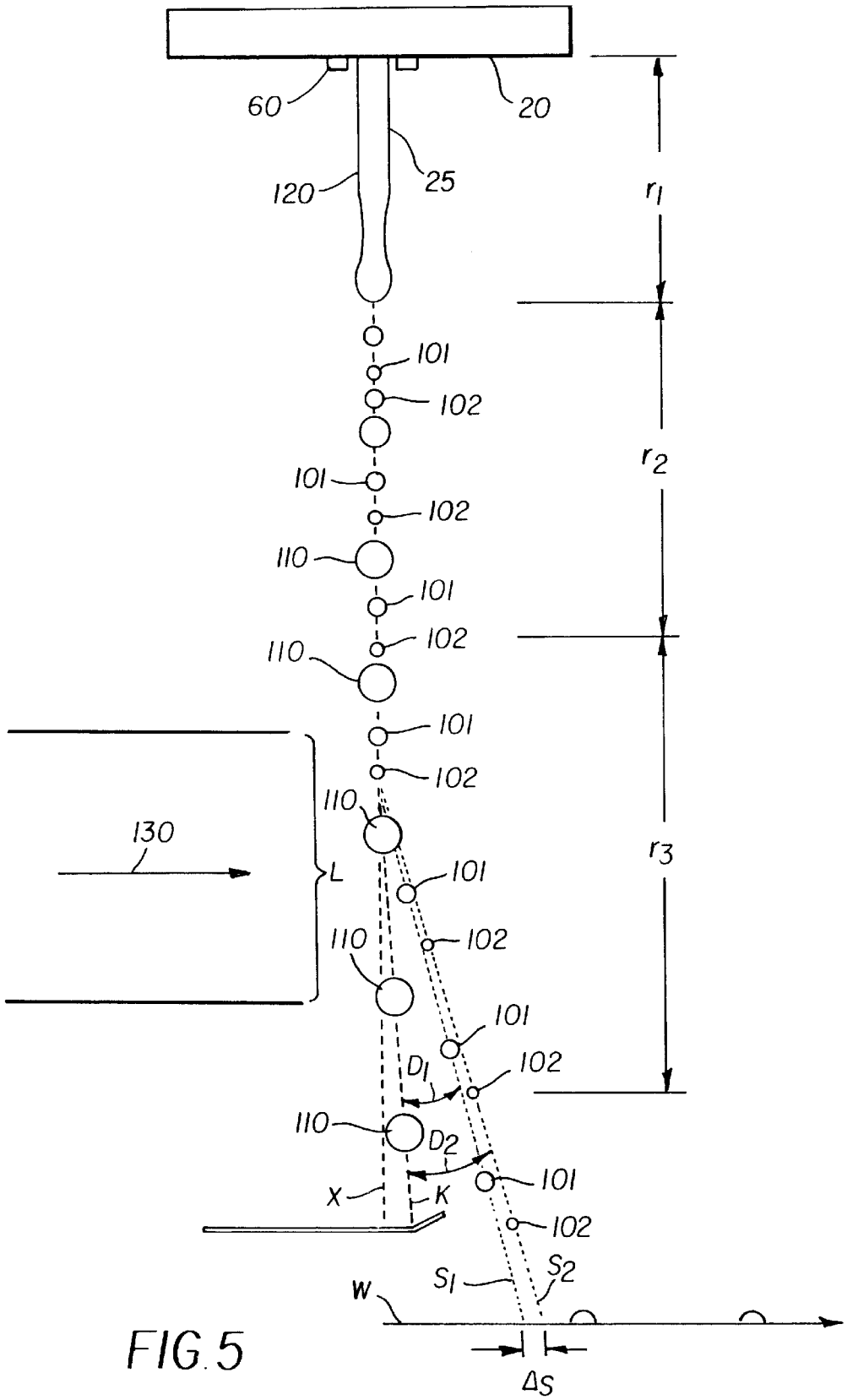
FIG. 5 is a cross-sectional view of an ink jet print head made in accordance with a first embodiment of the present invention.

Continuing with FIG. 5 in an example of a first embodiment of the present invention, print head 20 is operated in a manner such as to provide two printing drops per pixel. This is coupled with a gas-flow discrimination means to separate droplets into printing or non-printing paths according to drop volume. Large volume ink drops 110 and small volume ink drops 101 and 102 are formed from ink ejected in streams from print head 20 initially along ejection path X through aforementioned regions $r_1$ and $r_2$. As gas force 130 interacts with the stream of ink droplets in region $r_3$, the individual droplets separate, depending on volume. Large drops 110 are deflected along path K, while small drops 101 and 102 travel along paths $S_1$ and $S_2$, respectively. Since the volume of drops 102 is less than the volume of drops 101, drops 102 are deflected to a larger degree from initial path X by the gas flow 130. Paths $S_1$ and $S_2$ intersect the plane of the recording media W with a distance of separation, Δs. Recording media W is transported in the direction of gas flow 130, and moves a distance, Δl, from the time of impact of a first printing drop 101 to the time of impact of a second printing drop 102. It can be seen that in the case where Δs is equal to Δl, the apparent registration error due to receiver motion will be zero. For example, if Δl is 20 microns, and path X and path $S_1$ intersect the plane of the recording media W with a separation distance of 500 microns, time delay 84 must be approximately 12% shorter than time delay 83 for the registration error to be compensated. Higher receiver media transport rates will require more negative values of the factor R.

A second embodiment of the current invention is applicable when the motion of receiver media W is opposite to gas flow 130. This embodiment is described in part by FIG. 4, through diagrams (c) and (d). Diagram (c) represents the frequency of activation of heater 60, while schematic (d) is the resultant drop formation. As in the first embodiment described above, delay time 83 is not equal to delay time 84. In this case, however, delay time 84>delay time 83. Within the time for printing a pixel P, the volume of each drop successively increases, and the factor R takes on positive values.

Figure 6:
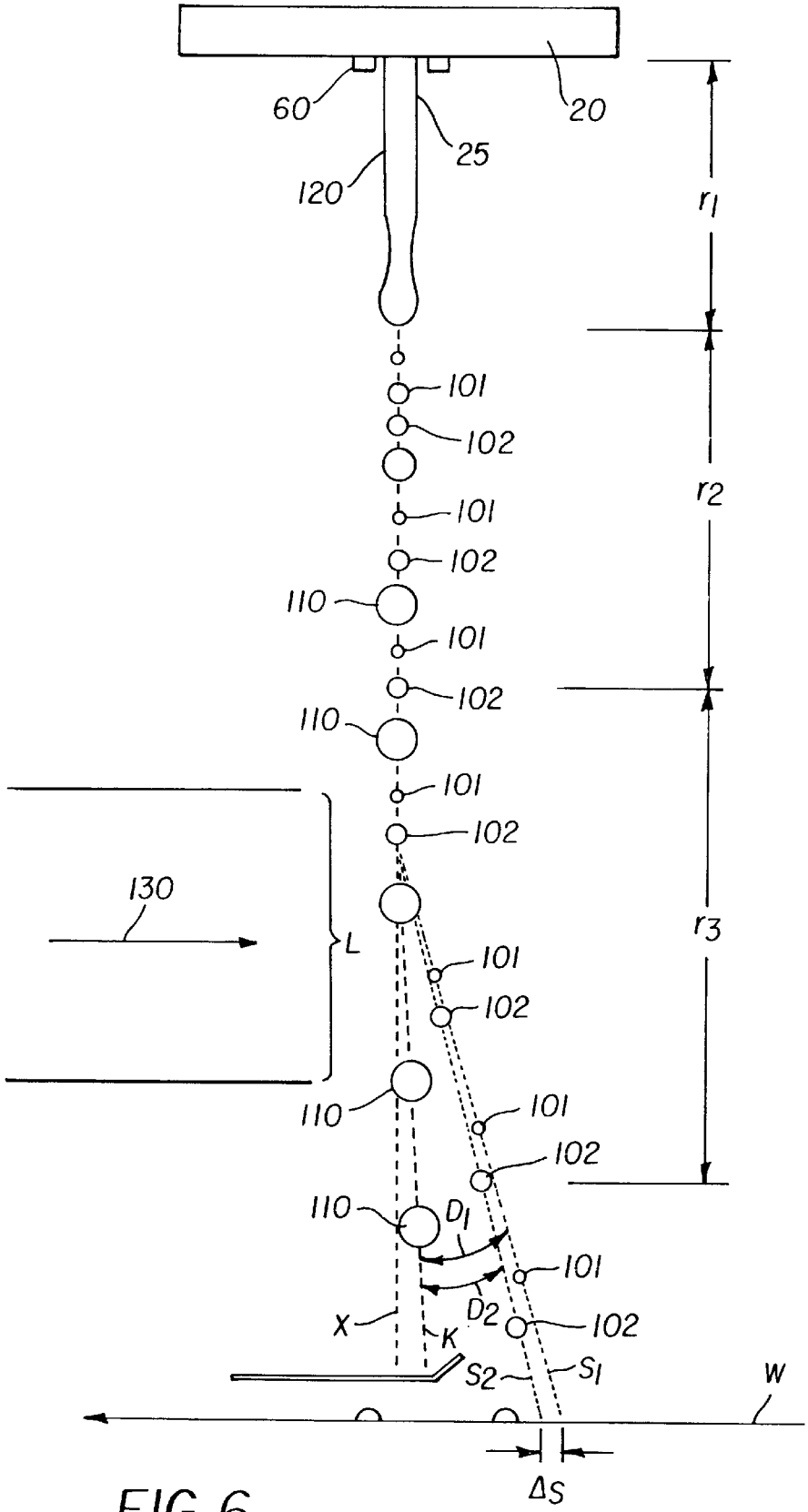
FIG. 6 is a cross-sectional view of an ink jet print head made in accordance with a second embodiment of the present invention.

FIG. 6 shows the effect of this reversal in order of drop sizes relative to FIG. 5. $S_1$ designates the path of the first drop in the pixel time interval, while $S_2$ designates the path of the second drop. In this case, path $S_2$ is deviates less than path $S_1$, relative to initial path X. Paths $S_1$ and $S_2$ intersect the plane of the recording media W with a distance of separation, Δs. When Δs is equal to the motion of the receiver media W, Δl, the misregistration error is compensated.

Figure 7:
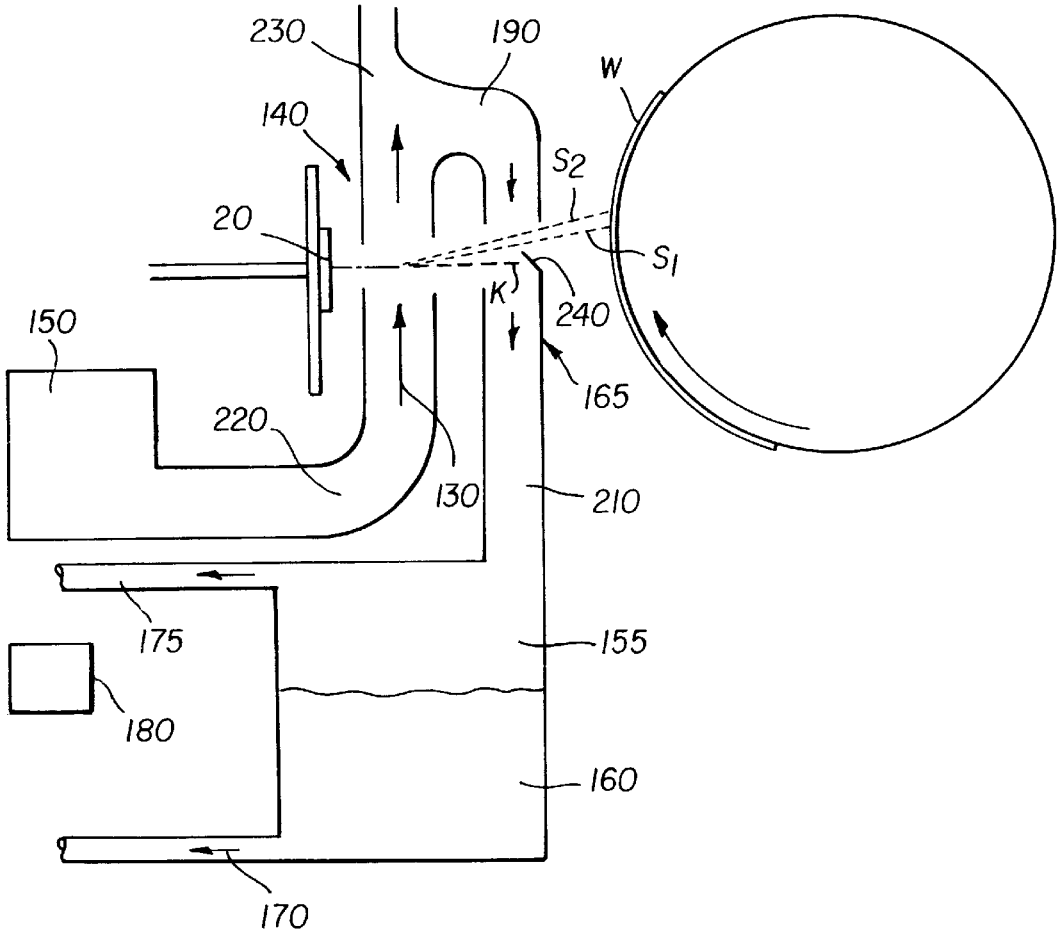
FIG. 7 is a schematic view of an ink jet printer made in accordance with either said first or second embodiment of the present invention.

Now referring to FIG. 7, a printing apparatus (typically, an ink jet printer or print head) used in an implementation of the current invention is shown schematically. The print head here contains a row of nozzles 25. Large volume ink drops 95, 105 and 110 (FIG. 4*b*) and small volume ink drops 101 and 102 (also FIG. 4*a*) are formed from ink ejected in streams from print head 20 substantially along ejection paths X. A droplet deflector 140 contains upper plenum 230 and lower plenum 220, which facilitate a laminar flow of gas in droplet deflector 140. Pressurized air from pump 150 enters lower plenum 220 which is disposed opposite plenum 230 and promotes laminar gas flow while protecting the droplet stream moving along path X from external air disturbances. The application of force 130 due to gas flow separates the ink droplets into small-drop paths $S_1$ and $S_2$ and large-drop path K.

An ink collection structure 165, disposed adjacent to plenum 220 near path X, intercepts path K of large drops 95, 105, and 110, while allowing small ink drops 100,101, and 102 traveling along small droplet paths $S_1$ and $S_2$ to continue on to the recording media W carried by print drum 200.

Large, non-printing ink drops 95, 105, and 110 strike ink catcher 240 in ink collection structure 165. Ink recovery conduit 210 communicates with recovery reservoir 160 to facilitate recovery of non-printed ink droplets by an ink return line 170 for subsequent reuse. A vacuum conduit 175, coupled to negative pressure source 180 can communicate with ink recovery reservoir 160 to create a negative pressure in ink recovery conduit 210 improving ink droplet separation and ink droplet removal as discussed above. The pressure reduction in conduit 210 is sufficient to draw in recovered ink, however it is not large enough to cause significant air flow to substantially alter drop paths $S_1$ and $S_2$. Ink recovery reservoir contains open-cell sponge or foam 155, which prevents ink sloshing in applications where the print head 20 is rapidly scanned.

A small portion of the gas flowing through upper plenum 230 is re-directed by plenum 190 to the entrance of ink recovery conduit 210. The gas pressure in droplet deflector 140 is adjusted in combination with the design of plenum 220 and 230 so that the gas pressure in the print head assembly near ink catcher 240 is positive with respect to the ambient air pressure near print drum 200. Environmental dust and paper fibers are thusly discouraged from approaching and adhering to ink catcher 240 and are additionally excluded from entering ink recovery conduit 210.

In operation, a recording media W is transported in a direction transverse to axis X by print drum 200 in a known manner. Transport of recording media W is coordinated with movement of print mechanism 10 and/or movement of print head 20. In addition, this can be accomplished using controller 40 in a known manner. Recording media W may be selected from a wide variety of materials including paper, vinyl, cloth, other fibrous materials, etc.

It will be understood that the principle of the invention may be applied to printers wherein the speed of the receiver media relative to the printhead in the so-called fast-scan direction may vary during the printing operation. Thus, the factor R can be continuously changing. The application of the appropriate timing for heater pulsing can then be derived from a look-up table based upon either measured or calculated velocity of the receiver media W. In addition, for printers in which the print head is rastered relative to the receiver media W in a bi-directional mode, the value of factor R will change sign in going from the forward direction to the reverse direction.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

What is claimed is:

1. A print head for printing an image, said print head comprising:

one or more nozzles from which a stream of ink droplets is emitted, the droplets having adjustable volumes of ink; and a mechanism, associated with each nozzle, adapted to independently adjust the volume of the ink droplets emitted by the associated nozzle, said mechanism having:

a first state wherein the volumes of the droplets emitted from the nozzles are within a first range of volumes, said first state being further defined by a substantially monotonically increasing or decreasing series of drop volumes within a grouping of two or more droplets, and a second state wherein the volumes of the droplets emitted from the nozzles are within a second range of volumes, wherein volumes within said second range are larger than volumes within said first range.

2. A print head as set forth in claim 1 wherein the mechanism adapted to adjust the volume of the ink droplets emitted by the nozzles comprises an individual heater associated with each nozzle.

3. An apparatus for printing an image comprising:

a print head having:

one or more nozzles from which a stream of ink droplets is emitted, the droplets having adjustable volumes of ink; and a mechanism, associated with each nozzle, adapted to independently adjust the volume of the ink droplets emitted by the associated nozzle, said mechanism having:

a first state wherein the volumes of the droplets emitted from the nozzles are within a first range of volumes, said first state being further defined by a substantially monotonically increasing or decreasing series of drop volumes within a grouping of two or more droplets, and a second state wherein the volumes of the droplets emitted from the nozzles are within a second range of volumes, volumes said second range being larger than volumes within said first range; and a droplet deflector adapted to produce a force on the emitted droplets, said force being applied to the droplets at an angle with respect to said stream of ink droplets to cause:

ink droplets within said first range of volumes to move along a first set of paths, and ink droplets within said second range of volumes to move along a second set of paths distinct from said first set of paths.

4. An apparatus as set forth in claim 3 further comprising a mechanism for transporting media at a predetermined transport velocity, and wherein the first state is further defined by a variation in droplet volumes which is related to the transport velocity of a receiver media.

5. An apparatus as set forth in claim 3 wherein the mechanism adapted to adjust the volume of the ink droplets emitted by the nozzles comprises an individual heater associated with each nozzle.

6. An apparatus as set forth in claim 3 further comprising an ink catcher positioned to allow droplets moving along said first set of paths to move unobstructed past the catcher, while intercepting droplets moving along said second set of paths.

7. A process for printing an image, said process comprising:

emitting a stream of ink droplets from one or more nozzles of a print head such that the droplets have adjustable volumes; and independently adjusting the volume of the ink droplets such that a first set of droplets are emitted with a first range of volumes that substantially monotonically increase or decrease in volumes within a grouping of two or more droplets, and a second set of droplets are emitted with a second range of volumes that are larger than said first range of volumes.

8. A process as set forth in claim 7 further comprising the step of producing a force on the emitted droplets, said force being applied to the droplets at an angle with respect to said stream of ink droplets to cause:

ink droplets within said first range of volumes to move along a first set of paths, and ink droplets within said second range of volumes to move along a second set of paths distinct from said first set of paths.

9. A process as set forth in claim 7 further comprising the steps of:

providing relative movement between media and the print head, and varying the volumes of the first set of droplets in relation to a velocity of the relative movement.

10. A process as set forth in claim 7 further comprising the steps of allowing drops moving along said first set of paths to move unobstructed past a catcher, while intercepting drops moving along said second set of paths.

* * * * *